US011619065B2

(12) United States Patent
Kalbande et al.

(10) Patent No.: US 11,619,065 B2
(45) Date of Patent: Apr. 4, 2023

(54) MICROWAVE DOOR PUSH BUTTON ASSEMBLY

(71) Applicant: WHIRLPOOL CORPORATION, Benton Harbor, MI (US)

(72) Inventors: Tushar Kalbande, Pune (IN); Ken Lei, ShenZhen (CN)

(73) Assignee: Whirlpool Corporation, Benton Harbor, MI (US)

( * ) Notice: Subject to any disclaimer, the term of this patent is extended or adjusted under 35 U.S.C. 154(b) by 1009 days.

(21) Appl. No.: 16/399,021

(22) Filed: Apr. 30, 2019

(65) Prior Publication Data

US 2020/0347637 A1 Nov. 5, 2020

(51) Int. Cl.

| | |
|---|---|
| ***E05B 1/00*** | (2006.01) |
| ***E05F 11/54*** | (2006.01) |
| ***H05B 6/64*** | (2006.01) |

(52) U.S. Cl.

CPC ..... *E05B 1/0038* (2013.01); *E05F 11/54* (2013.01); *H05B 6/6414* (2013.01)

(58) Field of Classification Search

CPC ..... E05B 1/0038; E05F 11/54; H05B 6/6414
See application file for complete search history.

(56) References Cited

U.S. PATENT DOCUMENTS

| | | | | |
|---|---|---|---|---|
| 4,006,121 | A | 2/1977 | Isono | |
| 4,875,721 | A | 10/1989 | Okamoto et al. | |
| 4,935,593 | A | 6/1990 | Nishikawa | |
| 5,668,358 | A * | 9/1997 | Wolf | H01H 13/705 200/345 |
| 5,857,720 | A | 1/1999 | Kim | |
| 9,318,282 | B2 * | 4/2016 | Nakajima | H01H 13/85 |
| 9,913,322 | B2 | 3/2018 | Davies | |
| 9,972,457 | B2 * | 5/2018 | Kitahara | H01H 13/14 |
| 11,223,266 | B2 * | 1/2022 | Ohishi | H02K 7/1853 |
| 2004/0007968 | A1 * | 1/2004 | Hanahara | H01H 13/7006 313/498 |
| 2010/0219057 | A1 * | 9/2010 | Okuzumi | H01H 23/30 200/5 A |
| 2011/0108403 | A1 * | 5/2011 | Kukita | H01H 13/28 200/341 |
| 2013/0069512 | A1 * | 3/2013 | Zimmer | H05B 6/6417 312/326 |
| 2013/0248336 | A1 * | 9/2013 | Kitahara | H01H 13/04 200/293 |

(Continued)

FOREIGN PATENT DOCUMENTS

| | | | |
|---|---|---|---|
| CN | 204201961 | U | 3/2015 |
| CN | 206646954 | U | 11/2017 |

(Continued)

*Primary Examiner* — Mark A Williams

(74) *Attorney, Agent, or Firm* — Price Heneveld LLP

(57) ABSTRACT

A push button assembly for a cooking appliance may include a button, a button base coupled to the button defining an interior, and a button support coupled to the button and disposed within the interior. The button support may include a boss defining a channel. A support pin may be rotatably coupled with the button support. A pin may be coupled with the button base and slidably received within the channel. The push button assembly may further include a lever having a first end and second end. The lever may define an aperture configured to receive the pin.

20 Claims, 7 Drawing Sheets

(56) References Cited

U.S. PATENT DOCUMENTS

| | | | | |
|---|---|---|---|---|
| 2013/0248340 | A1* | 9/2013 | Lehmann | H01H 13/10 200/530 |
| 2016/0225553 | A1* | 8/2016 | Guibert | H01H 23/02 |
| 2016/0340942 | A1* | 11/2016 | Anderson | E05B 83/28 |
| 2018/0082802 | A1* | 3/2018 | Yuan | H01H 13/14 |

FOREIGN PATENT DOCUMENTS

| | | | |
|---|---|---|---|
| GB | 2207180 | A | 1/1989 |
| JP | 49101944 | A | 9/1974 |
| JP | 5367141 | A | 6/1978 |
| JP | 63176926 | A | 7/1988 |
| KR | 19980032554 | U | 7/1998 |
| KR | 20070103247 | A | 10/2007 |
| KR | 100850018 | B1 | 8/2008 |

* cited by examiner

MICROWAVE DOOR PUSH BUTTON ASSEMBLY

BACKGROUND OF THE DISCLOSURE

The present disclosure generally relates to a cooking appliance door push button assembly, and more specifically, to a door opening push button mechanism for a microwave.

Typically, a microwave oven is an electrically powered apparatus which uses high frequency electromagnetic waves—microwaves—to heat and/or cook an item within an interior of the microwave. While the microwaves are useful to heat and/or cook an item within the interior, it is important to prevent harmful levels of microwave radiation from escaping. A door is provided to selectively cover the interior and may include an opening mechanism to allow a user to open the door from a closed position.

SUMMARY OF THE DISCLOSURE

According to one aspect of the present disclosure, a push button assembly for a cooking appliance is disclosed. The push button assembly includes a button. A button base is coupled to the button thereby defining an interior. A button support is coupled to the button and disposed within the interior. The button support has a first boss defining a first channel and a second boss defining a second channel. A first bearing is slidably received within the first channel and a second bearing is slidably received within the second channel. A first pin and a second pin are coupled with the button base. The first pin is slidably received within the first bearing and the second pin is slidably received within the second bearing. A lever has a first end and second end. The lever defines an aperture configured to receive the first bearing wherein an ejector pin is proximate to the first end of the lever and the second end of the lever is proximate to the button support.

According to another aspect of the present disclosure, a push button assembly for a cooking appliance is disclosed. The push button assembly includes a button. A button base is coupled to the button thereby defining an interior. A button support is coupled to the button and disposed within the interior. The button support has a boss defining a channel. A bearing is slidably received within the channel. A pin is coupled with the button base. The pin is slidably received within the bearing. A lever has a first end and second end. The lever defines an aperture configured to receive the bearing wherein an ejector pin is proximate to the first end of the lever and the second end of the lever is proximate to the button support.

According to yet another aspect of the present disclosure, a push button assembly for a cooking appliance is disclosed. The push button assembly includes a button. A button base is coupled to the button thereby defining an interior. A button support is coupled to the button and disposed within the interior. The button support has a boss defining a channel. A support pin is rotatably coupled with the button support. A pin is coupled with the button base and slidably received within the channel. A lever having a first end and second end. The lever defines an aperture configured to receive the pin.

These and other features, advantages, and objects of the present disclosure will be further understood and appreciated by those skilled in the art by reference to the following specification, claims, and appended drawings.

Figure 1:
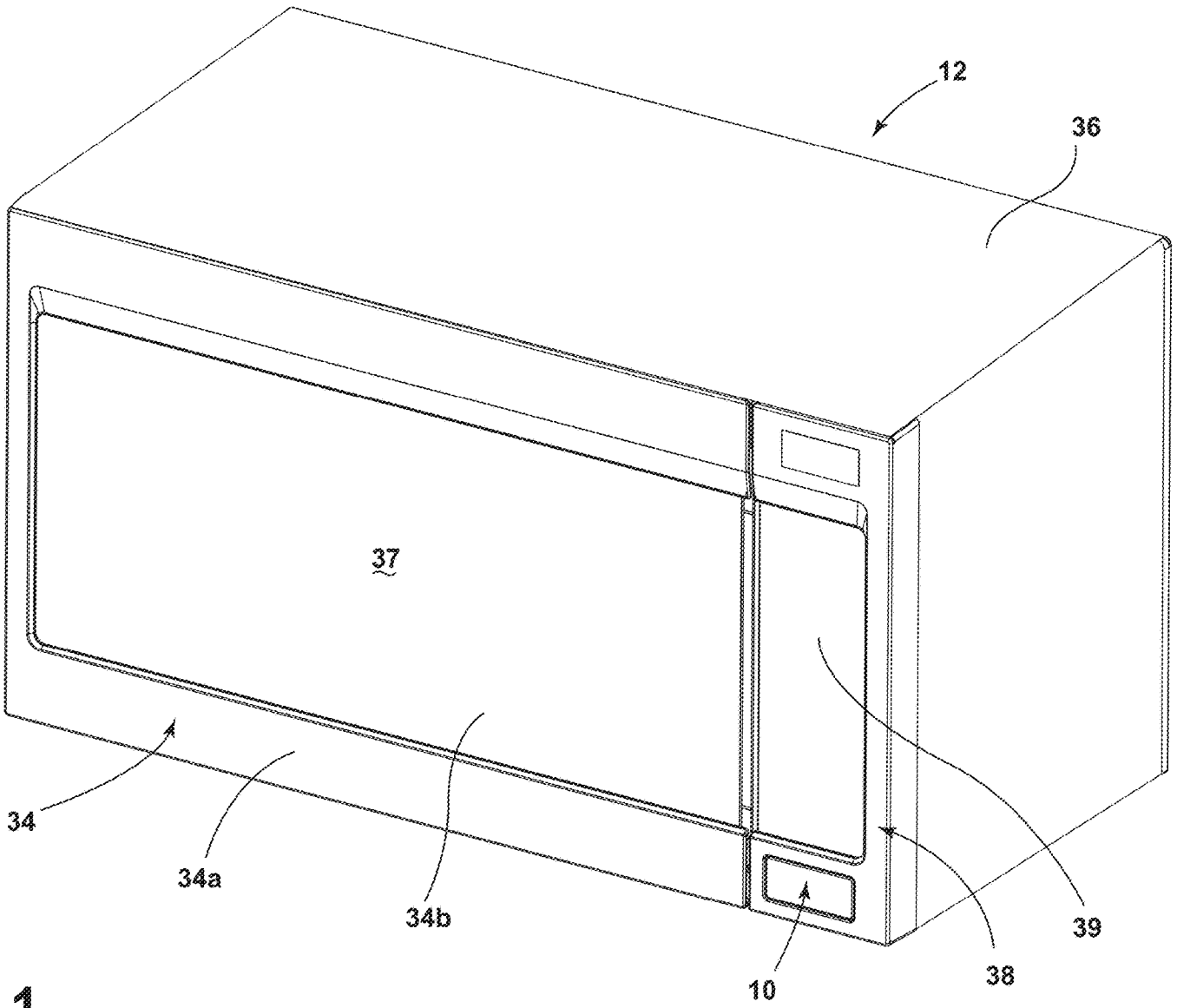
FIG. 1 is a perspective view of a microwave oven with a push button assembly according to various aspects described herein.

The components in the figures are not necessarily to scale, emphasis instead being placed upon illustrating the principles described herein.

DETAILED DESCRIPTION

The present illustrated embodiments reside primarily in combinations of method steps and apparatus components related to a cooking appliance door push button assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-6, reference numeral 10 generally designates a push button assembly for a cooking appliance 12. The push button assembly 10 may include a button 14 and a button base 16 coupled to the button 14 thereby defining an interior 18. A button support 20 may be coupled to the button 14 and disposed within the interior 18. The button support 20 may include a boss 22 defining a channel 24. A support pin 26, which may be in the form of a rod, may be rotatably coupled with the button support 20. A pin 28 may be coupled with the button base 16 and may be slidably received within the channel 24. The push button assembly 10 may further include a lever 30 having a first end 30*a* and second end 30*b*. The lever 30 may define an aperture 32 configured to receive the pin 28.

Referring now to FIG. 1, a cooking appliance 12 may be in the form of a microwave oven 12 with a door assembly 34 and is depicted in exemplary form according to various aspects described herein. While FIG. 1 illustrates a microwave oven 12, aspects described herein may be applicable to any appliance. The microwave oven 12 may include a cabinet 36 defining a cooking cavity, or interior 37, in which food may be placed for cooking. The cabinet 36 may be generally rectangular shaped defined by a plurality of enclosing surfaces, but is not limited to such a configuration. The cabinet 36 may be constructed of conventional materials suitable for use in an appliance that generates microwave radiation (e.g. metals, metal alloys, polymeric materials, and composites of these materials) including one or more metal layers, films, or similar structures configured for shielding the radiation from reaching the exterior of the cabinet 36.

Additionally, the microwave oven 12 may be provided with a control panel 38 adjacent the door assembly 34. The control panel 38 may include a user interface 39, which may include one or more input elements, such as push buttons, touch switches, and the like (not shown) for setting operation parameters for controlling the microwave oven 12. The user interface 39 may also include one or more display elements (not shown) for displaying information, such as time, operation selections, and the like to a user.

Figure 2A:
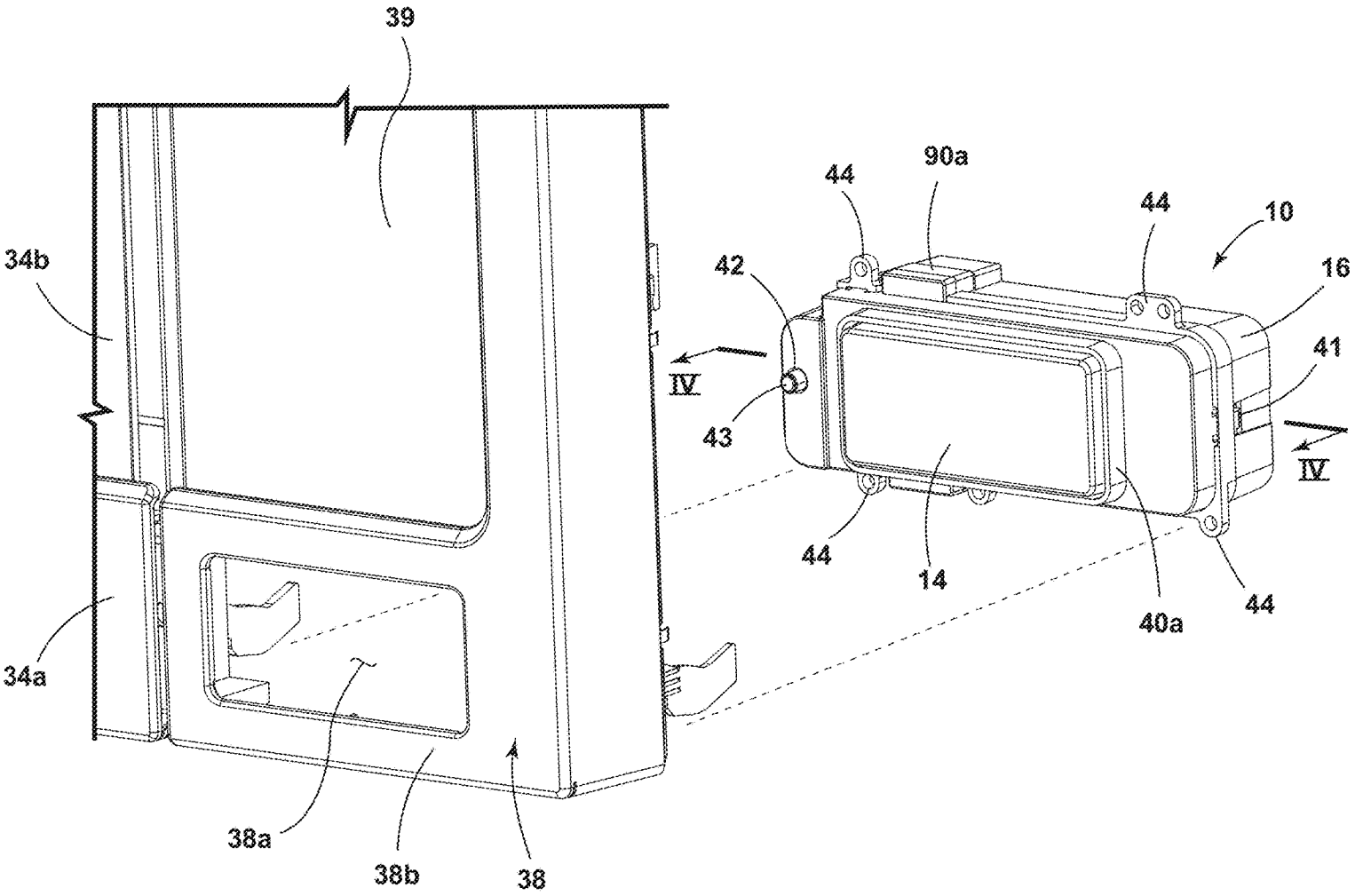
FIG. 2A is a perspective and partially exploded view of the push button assembly according to various aspects described herein.

The door assembly 34 may include a front frame 34*a*, which may couple with a glass panel 34*b*. The glass panel 34*b* may be substantially transparent such that the interior 37 may be visible by the user. The opening to the interior 37 may be selectively covered by the door assembly 34 between an open and a closed position. A user may actuate the push button assembly 10 to open the door. To close the door, the user may push the door assembly 34 into the closed position. In some examples, latch assemblies and the like may selectively lock the door assembly 34 in the closed position. In this way, the push button assembly 10 may facilitate disengagement of the latch assembly (not shown) to open the door assembly 34. FIG. 2A illustrates the push button assembly 10 removed from the cabinet 36. Portions of the cabinet 36 have been removed to better illustrate the positioning of the push button assembly 10, which may be provided in an aperture 38*a* defined in the control panel 38. In some examples, the aperture 38*a* may be located near a bottom 38*b* of the control panel 38 and proximate to the door assembly 34.

The push button assembly 10 may further include a button cover 40. The button cover 40 and the button base 16 may be coupled to assemble the push button assembly 10 and define an interior (FIG. 4) of the push button assembly 10. In some examples, the button cover 40 and button base 16 may be coupled via at least one clip assembly 41. The button cover 40 may include a bezel 40*a* defining an aperture (FIG. 3) configured to receive the button 14. However, in some examples, the button 14 and the button cover 40 may be configured as a unitary piece. Additionally, the button cover 40 may define a pin aperture 42 configured to receive an ejector pin 43. The button base 16 may include a plurality of mounting flanges 44 defining apertures configured to retain a fastener (not shown), such as screws, pins and the like for mounting the push button assembly 10 to the cabinet 36, which is more clearly shown in FIG. 2B.

Figure 2B:
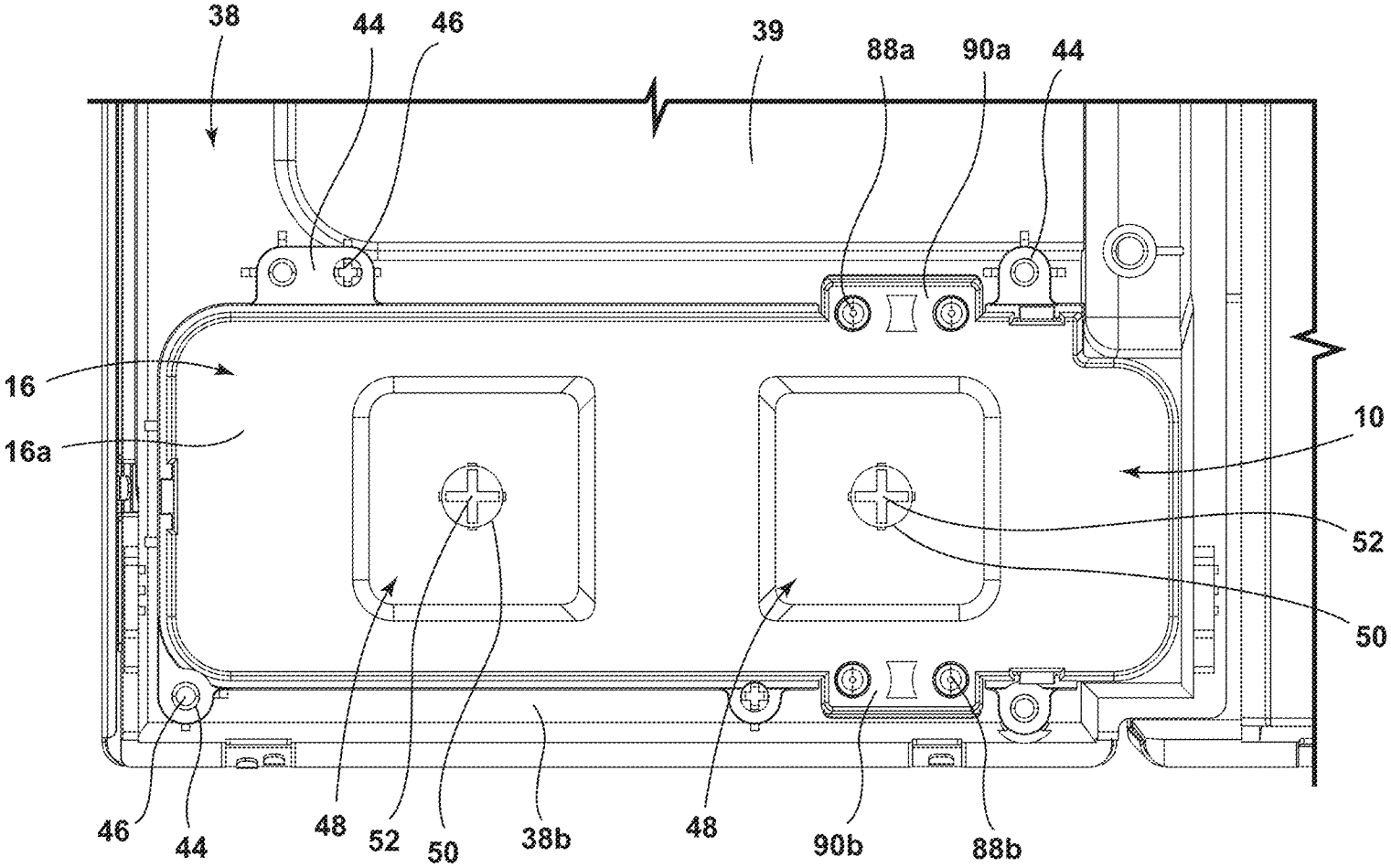
FIG. 2B is a rear view of the assembled push button assembly of FIG. 2A.

Referring now to FIG. 2B, the push button assembly 10 is illustrated as mounted to the control panel 38 of the cabinet 36. The mounting flanges 44 may include one or more apertures 46 for retaining the fastener. In some examples, a rear side 16*a* of the button base 16 may include at least one raised area 48 defining an aperture 50 for receiving a fastener, such as a screw 52. While illustrated as being raised, it is also contemplated that the raised area 48 may be flush with the rear side 16*a*. The screw 52 may be configured to retain a pin (FIG. 3) within the interior, which will be described in greater detail below.

Figure 3:
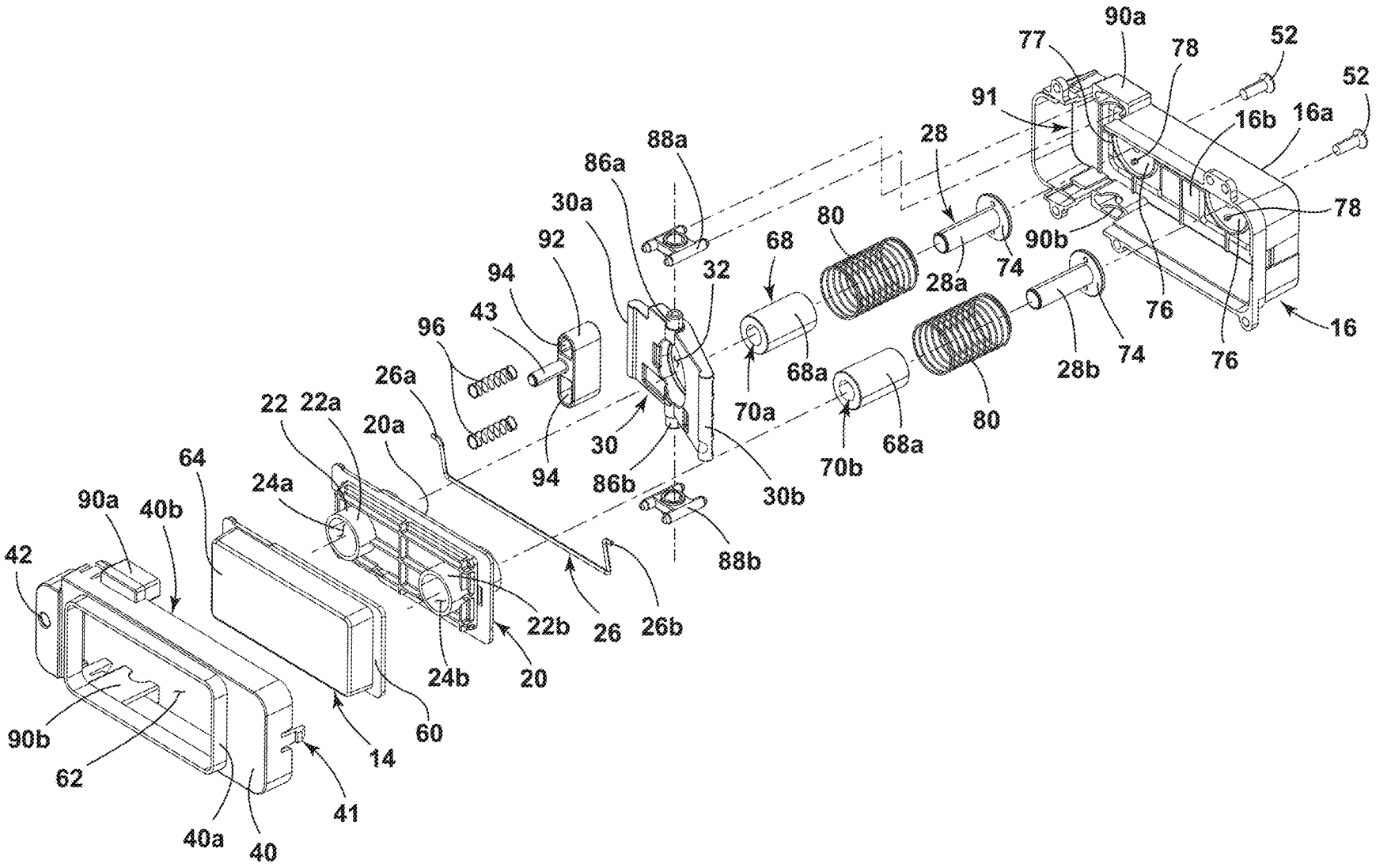
FIG. 3 is an exploded view of the push button assembly according to various aspects described herein.

FIG. 3 illustrates an exploded view further illustrating components of the push button assembly 10 according to various aspects described herein. In some examples, the button 14 includes a flange 60 configured to abut the button cover 40 such that the button 14 may be retained within an aperture 62 defined by the button cover 40. The button 14 may additionally include a cladding 64, which may cover a front surface of the button 14 for decorative or structural purposes. The button support 20 may be positioned between the button 14 and the button base 16. The button cover 40, the button 14, the button support 20 and the button base 16 may be formed of any suitable material, such as plastics, metals and the like. In some examples, the button cover 40, the button 14, the button support 20 and the button base 16 are made of the same, or different materials and may be formed by injection molding, casting, tooling, additive manufacturing etc.

In some examples, the button support 20 may include bosses 22, such as a first boss 22*a* defining a first channel 24*a* and a second boss 22*b* defining a second channel 24*b*. The channels 24*a*, 24*b* may include a cylindrical configuration, which may be configured to receive bearings 68, or first and second bearings 68*a*, 68*b*. The bearings 68 may be in the form of bush bearings, or any bearing suitable for providing a sliding bearing surface. The bearings 68*a*, 68*b* may define bearing channels 70*a*, 70*b*, respectively, which may be sized to receive the pins 28. The pins 28 may include a first pin 28*a* and a second pin 28*b*, each having a flange 74 on one end and may be formed of metal, or any other suitable material. The flanges 74 may abut the corresponding bearing 68*a*, 68*b* and function as a stop. The sliding bearing surface may be advantageous for providing a low friction surface between the bearings 68*a*, 68*b* and the pins 28*a*, 28*b*, which may result in a smooth, noiseless operation. Furthermore, the bearings 68*a*, 68*b* may provide durable, firm contact with the pins 28*a*, 28*b*, which may aid in the reduction of wobble of the button 14.

The flanges 74 may be sized to mate with a corresponding pin recess 76 on an interior side 16*b* of the button base 16. The pin recesses 76 may be formed via a bezel 77, or alternatively, as a depression in the button base 16. Furthermore, the flange 74 may define apertures 79 (FIG. 5) configured to receive corresponding projections 78 disposed within the pin recess 76 in order to align and/or retain the pins 28 within the pin recess 76. In this way, the corresponding bosses 22, the bearings 68 and the pins 28, are in alignment. It is contemplated that springs 80 may extend about, or may circumscribe, the bosses 22*a*, 22*b* and may abut and/or be retained within the pin recesses 76 to provide a spring force between the button support 20 and the button base 16.

The lever 30 may be provided in between the button support 20 and the button base 16. In some examples, the aperture 32 may be sized to receive one spring 80. Thus, the aperture 32 may receive a corresponding spring 80, boss 22, channel 24, bearing 68, and pin 28. The lever 30 may include an upper projection 86*a* and a lower projection 86*b*, which may be coupled with an upper support structure 88*a* and a lower support structure 88*b*, respectively. The support structures 88*a*, 88*b* may be received within a corresponding upper and lower support structure housing 90*a*, 90*b*, respectively. The upper and lower support structure housings 90*a*, 90*b* may be formed on the button cover 40 and the button base 16 such that when the push button assembly 10 is assembled, the upper and lower support structure housings 90*a*, 90*b* enclose the upper support structure 88*a* and the lower support structure 88*b*, respectively. The support structures 88*a*, 88*b* may retain the lever 30 in position while simultaneously allowing rotational movement of the lever 30 with respect to the first end 30*a* and the second end 30*b*. In some examples, the support structure housings 90*a*, 90*b* may retain the upper projection and lower projections 86*a*, 86*b* without the support structures 88*a*, 88*b*.

The button base 16 may include a cavity 91 configured to receive the first end 30*a* of the lever 30 and an ejector pin housing 92. The ejector pin housing 92 may include the ejector pin 43 and channels 94. The channels 94 may be configured to receive springs 96, which may provide a spring force between the ejector pin housing 92 and the button cover 40. In an assembled configuration, the ejector pin housing 92 may be proximate to and/or abut the first end 30*a* of the lever 30 such that the first end 30*a* is disposed between the ejector pin housing 92 and the interior side 16*b* of the button base 16.

The support pin 26 may be coupled with a rear side 20*a* of the button support 20. The support pin 26 may include a first end 26*a* and a second end 26*b*. The first end 26*a* and the second end 26*b* may extend beyond the width of the button 14, the button flange 60 and the button support 20 such that the ends 26*a*, 26*b* may couple with a rear side 40*b* of the button cover 40 when the push button assembly 10 is assembled. The support pin 26 is described in greater detail in reference to FIG. 5.

Figure 4:
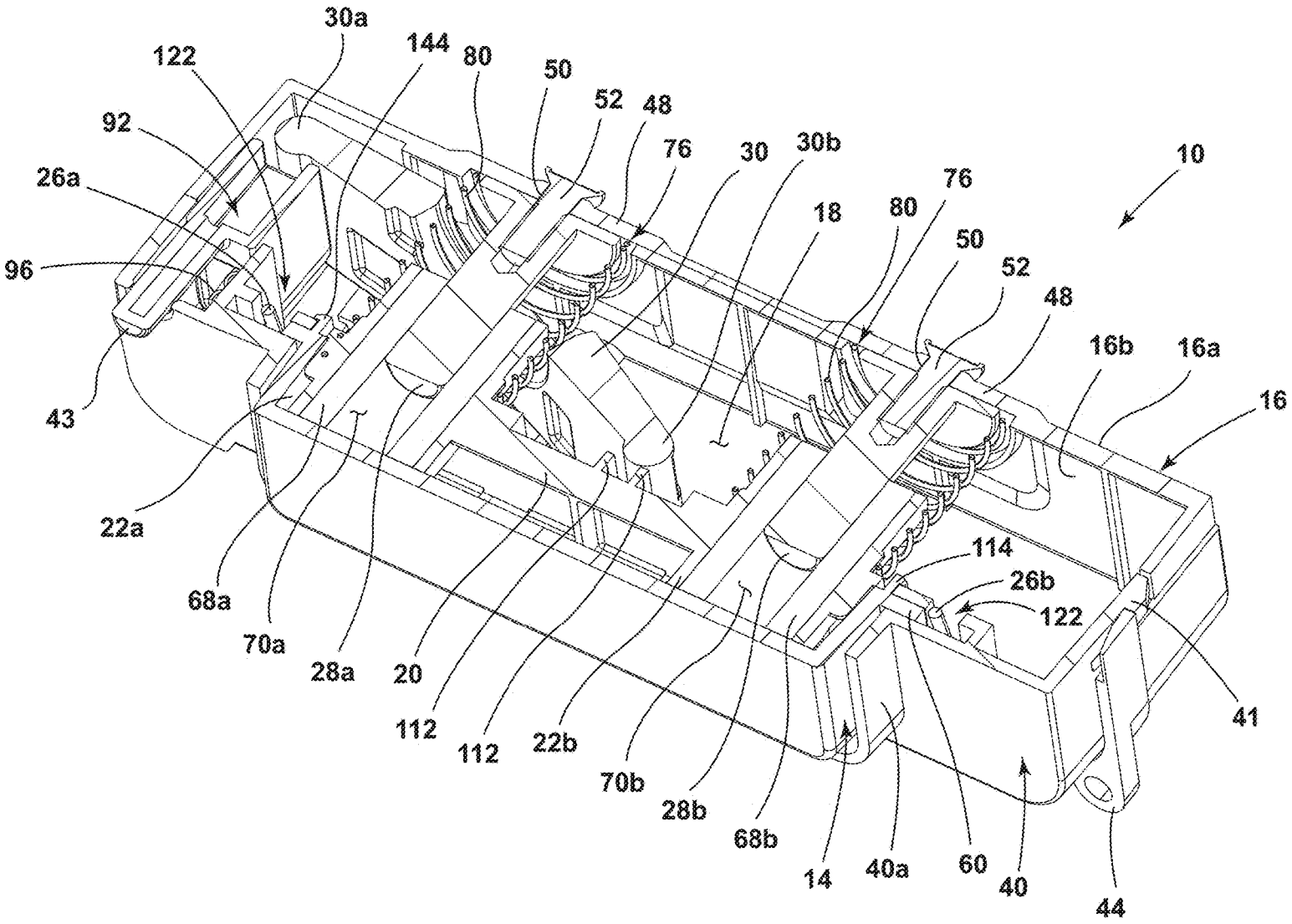
FIG. 4 is a perspective, cross-sectional view of the push button assembly along line IV-IV of FIG. 2A.

FIG. 4 is a cross-sectional view of the push button assembly 10 along line IV-IV of FIG. 2A more clearly illustrating the assembled push button assembly 10 and the interior 18. Here it may be seen that the pins 28*a*, 28*b* and the bearing channels 70*a*, 70*b* may be sized in order to form a clearance fit. In this way, the pins 28*a*, 28*b* may be slidable relative to the corresponding bearing channels 70*a*, 70*b*. In some examples, the clearance fit is a sliding fit having minimal clearances in order to maintain firm contact between the bearing 68 and the pin 28. Alternatively, the clearance fit may be a location fit, having even closer clearances such that the pin 28 may slide within the bearing channel 70 when lubricated. Additionally, the bearings 68*a*, 68*b* may be sized in order to form a transition fit or an interference fit with the bosses 22*a*, 22*b* such that the bearings 68*a*, 68*b* and the corresponding bosses 22*a*, 22*b* may be substantially fixed and may move as a unitary piece.

In FIG. 4, the lever 30 is illustrated in a rest position. The first end 30*a* and the second end 30*b* of the lever 30 may be rounded such that a cross-section of the first end 30*a* and the second end 30*b* may be substantially circular in shape. The button support 20 may include a rib 112 or a pair of ribs 112 proximate to and in alignment with the second end 30*b*. In this way, the pair of ribs 112 may contact the second end 30*b* during movement. Furthermore, the button 14 may include one or more clip projections 114. The clip projections 114 may extend through a corresponding aperture (FIG. 5) in the button support 20 in order to couple the button 14 and the button support 20. In this way, the button 14 and the button support 20 may be fixed. Therefore, it is contemplated that the button 14 and the button support 20 may be formed as a unitary piece.

Figure 5:
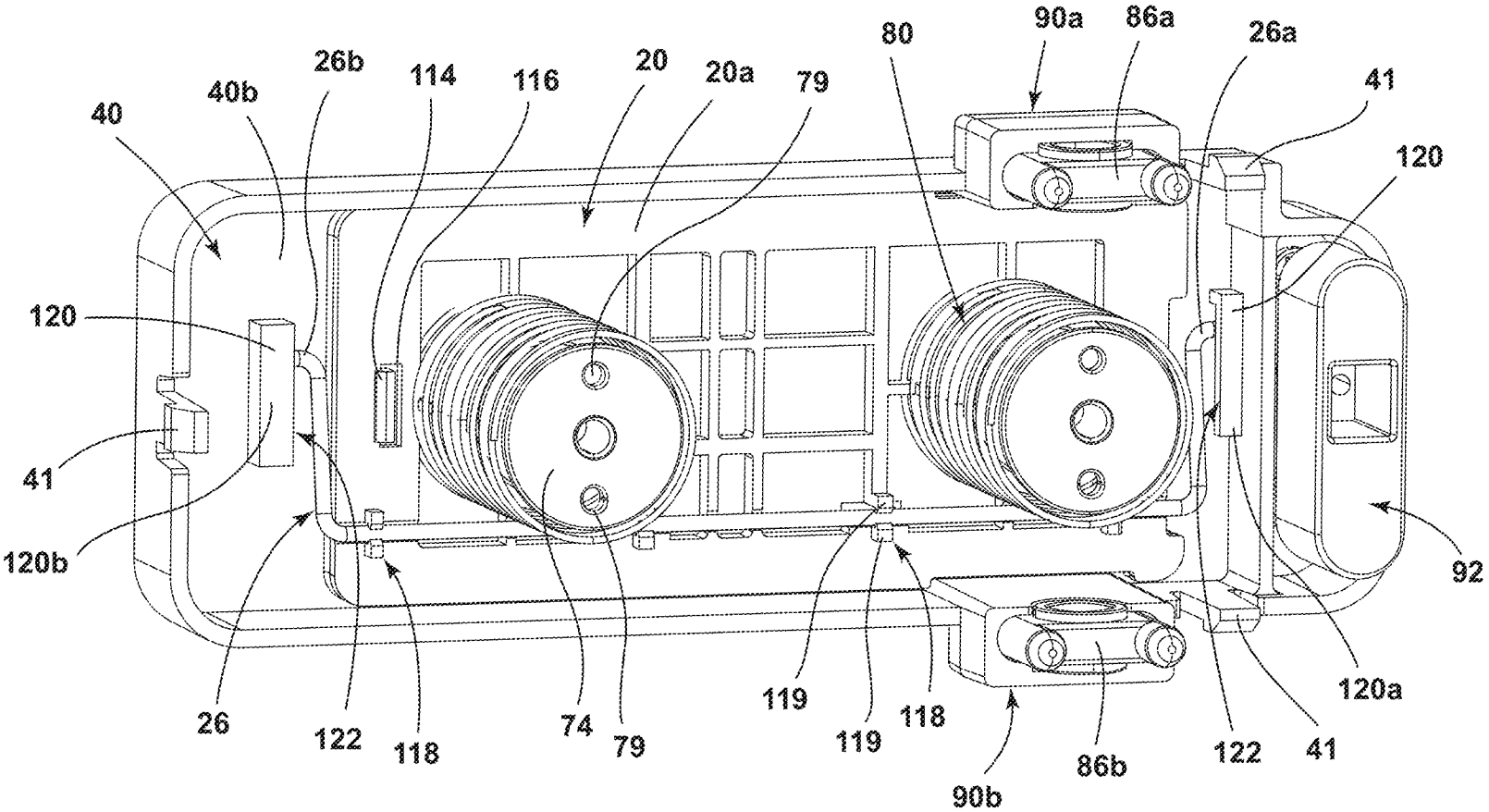
FIG. 5 is a rear view of a portion of the push button assembly according to various aspects described herein.

FIG. 5 is a rear view of a portion of the push button assembly 10 with the button base 16 removed in order to more clearly view the support pin 26 and the clip projection 114 on the button 14. The clip projection 114 may extend through a corresponding aperture 116 and beyond the rear side 20*a* of the button support 20. The rear side 20*a* of the button support 20 may include one or more clips 118 configured to rotatably couple the support pin 26. Each clip 118 may include a pair of ribs 119 spaced vertically, which may receive the support pin 26, which is positioned in a longitudinal direction. In this way, the support pin 26 may be press fit into the clips 118. In some examples, four clips 118 are spaced along the rear side 20*a*. While illustrated as ribs 119, the clips 118 may be configured in any suitable matter in order to rotatably couple the support pin 26 and the button support 20. The support pin 26 may be advantageous for providing support to the button 14 and the button support 20 during movement such that wobble is avoided. For example, the user may push on a corner of the push button assembly 10, which may typically produce a wobble effect. However, the structure of the push button assembly 10 described herein, including the support pin 26 may prevent wobble of the button 14 from occurring.

Furthermore, the rear side 40*b* of the button cover 40 may include at least one pin housing 120. In some examples, the rear side 40*b* includes first and second pin housings 120*a*, 120*b* configured to receive the first end 26*a* and the second end 26*b* of the support pin 26, respectively. The pin housings 120*a*, 120*b* may define slots 122. The slots 122 may be elongated in order to retain the first end 26*a* and the second end 26*b* during movement. For example, when the button 14 and button support 20 are displaced from the button cover 40.

Figure 6:
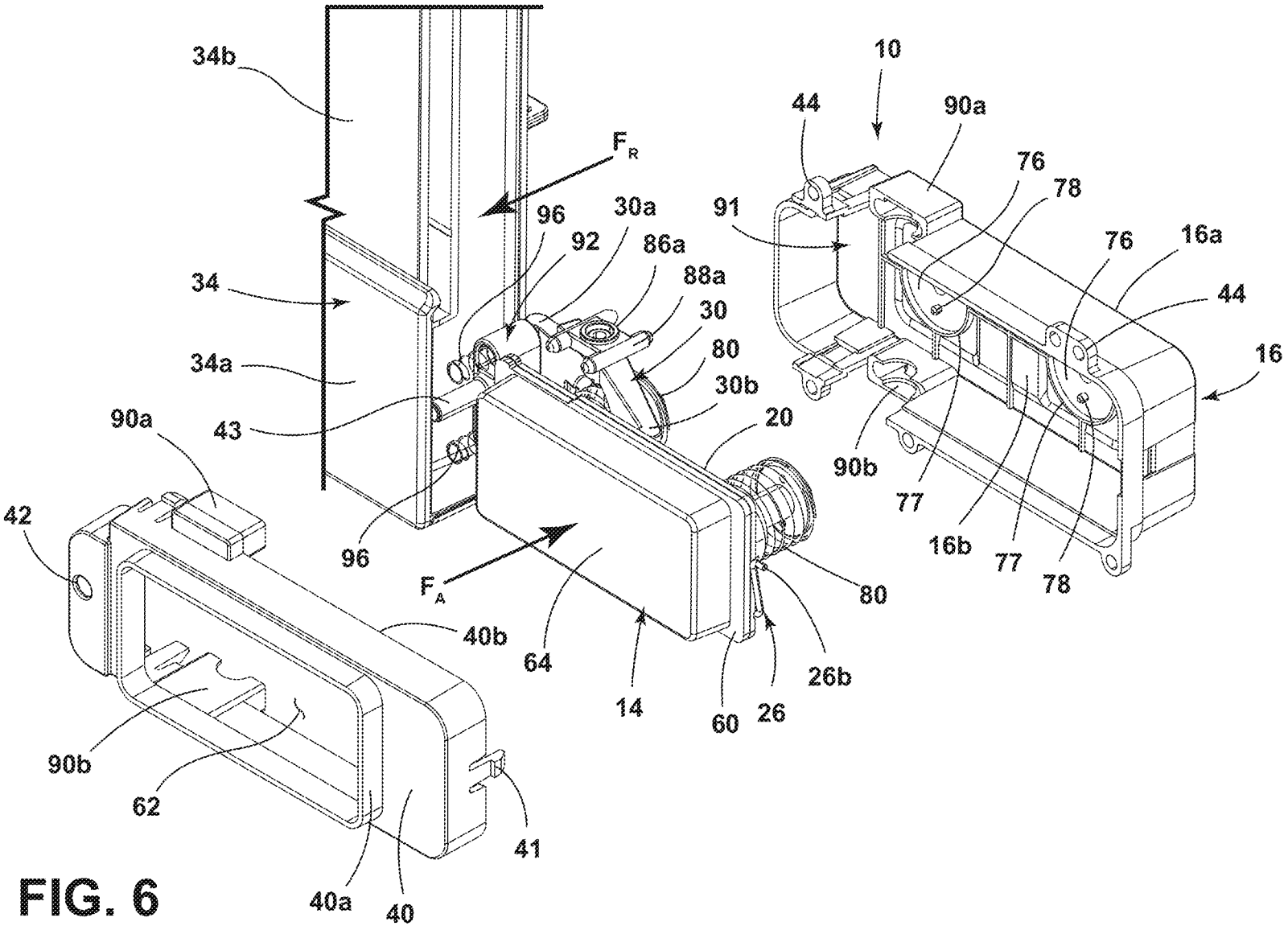
FIG. 6 is a perspective view of portions of the push button assembly according to various aspects described herein.

FIG. 6 is a perspective view of the push button assembly 10, partially disassembled in order to more clearly see the internal components of the push button assembly 10 in operation. In order to open the door assembly 34 a user may apply an action force, $F_A$, to actuate the push button assembly 10. The action force, $F_A$, may include the user pressing the push button assembly 10 inward or forward, which may include the use of at least one finger. The action force, $F_A$, may result in a reaction force, $F_R$, which may cause the door assembly 34 to open. The reaction force, $F_R$, may be produced by the lever 30.

For example, the lever 30 may shift from a rest position (FIG. 4) to an eject position (FIG. 6). In some examples, the action force, $F_A$, may cause the button 14, including the button support 20, to contact the second end 30*b* of the lever 30. Continuing the action force, $F_A$, may cause the second end 30*b* to move towards the interior side 16*b* of the button base 16, while the first end 30*a* may move towards the ejector pin housing 92. Simultaneously, the button 14 and button support 20 may slide toward the pins 28 within the bearing channels 70, compressing the springs 80. Completing the action force, $F_A$, may result in the first end 30*a* displacing the ejector pin housing 92 towards the button cover 40, while compressing the springs 96, such that the ejector pin 43 extends outwardly from the pin aperture 42 towards the front frame 34*a* of the door assembly 34. The force of the ejector pin 43 on the front frame 34*a* may cause the door assembly 34 to move into an open position, which may include facilitating disengagement of a latch assembly. Upon release of the action force, $F_A$, the springs 80 and 96 may decompress, or expand, and return the lever 30 and button 14 to the rest position thereby allowing the button 14 to move backwards.

Benefits of various aspects described herein may include a push button assembly 10 having a substantially smooth and noiseless operation of forward and backward movement while the user opens the door assembly 34 of the microwave oven 12. According to aspects described herein, the required pushing force by the user to open the door assembly 34 using the push button assembly 10 may be reduced from a typical push force of approximately 10 pounds to approximately 4.5 to 6 pounds. Furthermore, various aspects described herein may provide for a durable push button assembly with a reduction in wobbling of the button 14 in the event the user pushes on a corner position of the button 14. Even further, assembly time may be reduced as the push button assembly 10 according to various aspects described herein may be constructed as a singular assembly without loose parts that is easily mounted within the microwave oven 12. In this way, the push button assembly 10 according to various aspects described herein may be easily removable and replaceable such that maintenance time may be significantly reduced in the event of a need for service.

According to one aspect of the present disclosure, a push button assembly for a cooking appliance may include a button, a button base coupled to the button thereby defining an interior, and a button support coupled to the button and disposed within the interior. The button support may include a first boss defining a first channel and a first boss defining a second channel. A first bearing may be slidably received within the first channel and a second bearing may be slidably received within the second channel. A first pin and a second pin may be coupled with the button base, the first pin slidably received within the first bearing and the second pin slidably received within the second bearing. A lever may include a first end and second end. The lever may define an aperture configured to receive the first bearing. An ejector pin may be proximate to the first end of the lever and the second end of the lever may be proximate to the button support.

According to another aspect of the present disclosure, the push button assembly may further include a button cover coupled with the button base, the button cover defining an aperture configured to receive the button.

According to yet another aspect of the present disclosure, the push button assembly may further include a support pin rotatably coupled with the button support, the support pin having an end coupled with one of the button and the button cover.

According to yet another aspect of the present disclosure, the one of the button and button cover may further include a pin housing defining a slot configured to receive the end of the support pin.

According to yet another aspect of the present disclosure, the push button assembly may further include a support pin rotatably coupled with the button support, the button support having a clip configured to receive the support pin.

According to yet another aspect of the present disclosure, upon applying a force to the button, the button support may abut the second end of the lever thereby shifting the first end of the lever from a rest position to an eject position wherein the ejector pin may be pushed outwardly.

According to one aspect of the present disclosure, a push button assembly for a cooking appliance may include a button, a button base coupled to the button thereby defining an interior, and a button support coupled to the button and disposed within the interior. The button support may include a boss defining a channel, a bearing slidably received within the channel, and a pin coupled with the button base. The pin may be slidably received within the bearing. A lever may include a first end and second end. The lever may define an aperture configured to receive the bearing. An ejector pin may be proximate to the first end of the lever and the second end of the lever may be proximate to the button support.

According to another aspect of the present disclosure, the push button assembly may further include a button cover coupled with the button base, the button cover defining an aperture configured to receive the button.

According to yet another aspect of the present disclosure, the push button assembly may further include a support pin rotatably coupled with the button support, the support pin having an end coupled with one of the button and the button cover.

According to yet another aspect of the present disclosure, the one of the button and button cover may further include a pin housing defining a slot configured to receive the end of the support pin.

According to yet another aspect of the present disclosure, the push button assembly may further include a support pin rotatably coupled with the button support, the button support having a clip configured to receive the support pin.

According to yet another aspect of the present disclosure upon applying a force to the button, the button support may abut the second end of the lever thereby shifting the first end of the lever from a rest position to an eject position wherein the ejector pin is pushed outwardly.

According to one aspect of the present disclosure, a push button assembly for a cooking appliance may include a button, a button base coupled to the button thereby defining an interior, and a button support coupled to the button and disposed within the interior. The button support may include a boss defining a channel. A support pin may be rotatably coupled with the button support. A pin may be coupled with the button base and slidably received within the channel. A lever may include a first end and second end. The lever may define an aperture configured to receive the pin.

According to yet another aspect of the present disclosure, the push button assembly may further include a button cover coupled with the button base, the button cover defining an aperture configured to receive the button.

According to yet another aspect of the present disclosure, the support pin may further include an end coupled with the button cover.

According to yet another aspect of the present disclosure, the button cover may further include a pin housing defining a slot configured to receive the end of the support pin.

According to yet another aspect of the present disclosure, the support pin may further comprise a first end and a second end, the first end and the second end extending beyond the button support.

According to yet another aspect of the present disclosure, the button support may further include a clip configured to receive the support pin.

According to yet another aspect of the present disclosure, the support pin may further comprise an end coupled with the button.

According to yet another aspect of the present disclosure, upon applying a force to the button, the button support may abut the second end of the lever thereby shifting the first end of the lever from a rest position to an eject position.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A push button assembly for a cooking appliance, the push button assembly comprising:

a button;

a button base coupled to the button thereby defining an interior of the push button assembly;

a button support coupled to the button and disposed within the interior, the button support having a first boss defining a first channel and a second boss defining a second channel;

a first bearing slidably received within the first channel and a second bearing slidably received within the second channel;

a first pin and a second pin coupled with the button base, the first pin slidably received within the first bearing and the second pin slidably received within the second bearing;

a lever having a first end and second end, the lever defining an aperture therein, the aperture configured to receive the first bearing; and an ejector pin operably coupled with the button, wherein the ejector pin is proximate to the first end of the lever and the second end of the lever is proximate to the button support, further wherein the first end of the lever is configured to displace the ejector pin upon application of a pressing force to the button.

2. The push button assembly of claim 1, further comprising:

a button cover coupled with the button base, the button cover defining an aperture configured to receive the button.

3. The push button assembly of claim 2, further comprising:

a support pin rotatably coupled with the button support, the support pin having an end coupled with one of the button and the button cover.

4. The push button assembly of claim 3, wherein the one of the button and button cover further comprises a pin housing defining a slot configured to receive the end of the support pin.

5. The push button assembly of claim 2, further comprising:

a support pin rotatably coupled with the button support, the button support having a clip configured to receive the support pin.

6. The push button assembly of claim 1, wherein upon applying a force to the button, the button support abuts the second end of the lever thereby shifting the first end of the lever from a rest position to an eject position wherein the ejector pin is pushed outwardly.

7. A push button assembly for a cooking appliance, the push button assembly comprising:

a button;

a button base coupled to the button thereby defining an interior of the push button assembly;

a button support coupled to the button and disposed within the interior, the button support having a boss defining a channel;

a bearing slidably received within the channel;

a pin coupled with the button base, the pin slidably received within the bearing;

a lever having a first end and second end, the lever defining an aperture therein, the aperture configured to receive the bearing; and an ejector pin operably coupled with the button, wherein the ejector pin is proximate to the first end of the lever and the second end of the lever is proximate to the button support, further wherein the first end of the lever is configured to push the ejector pin outwardly.

8. The push button assembly of claim 7, further comprising:

a button cover coupled with the button base, the button cover defining an aperture configured to receive the button.

9. The push button assembly of claim 8, further comprising:

a support pin rotatably coupled with the button support, the support pin having an end coupled with one of the button and the button cover.

10. The push button assembly of claim 9, wherein the one of the button and button cover further comprises a pin housing defining a slot configured to receive the end of the support pin.

11. The push button assembly of claim 7, further comprising:

a support pin rotatably coupled with the button support, the button support having a clip configured to receive the support pin.

12. The push button assembly of claim 7, wherein upon applying a force to the button, the button support abuts the second end of the lever thereby shifting the first end of the lever from a rest position to an eject position wherein the ejector pin is pushed outwardly.

13. A push button assembly for a cooking appliance, the push button assembly comprising:

a button;

a button base coupled to the button thereby defining an interior of the push button assembly;

a button support coupled to the button and disposed within the interior, the button support having a boss defining a channel;

a support pin rotatably coupled with the button support;

a button base pin coupled with an interior side of the button base and slidably received within the channel; and a lever having a first end and second end, the lever defining an aperture therein, the aperture configured to receive the button base pin.

14. The push button assembly of claim 13, further comprising:

a button cover coupled with the button base, the button cover defining an aperture configured to receive the button.

15. The push button assembly of claim 14, wherein the support pin further comprises an end coupled with the button cover.

16. The push button assembly of claim 15, wherein the button cover further comprises a pin housing defining a slot configured to receive the end of the support pin.

17. The push button assembly of claim 13, wherein the support pin further comprises a first end and a second end, the first end and the second end extending beyond the button support.

18. The push button assembly of claim 13, wherein the button support further comprises a clip configured to receive the support pin.

19. The push button assembly of claim 13, wherein the support pin further comprises an end coupled with the button.

20. The push button assembly of claim 13, wherein upon applying a force to the button, the button support abuts the second end of the lever thereby shifting the first end of the lever from a rest position to an eject position.

* * * * *